US005111782A

United States Patent [19]

Mezger

[11] Patent Number: 5,111,782

[45] Date of Patent: May 12, 1992

[54] RECIPROCATING ENGINE WITH A GEAR DRIVE

[75] Inventor: Hans Mezger, Freiberg, Fed. Rep. of Germany

[73] Assignee: Dr. Ing h.c.F. Porsche AG, Fed. Rep. of Germany

[21] Appl. No.: 669,011

[22] Filed: Mar. 13, 1991

[30] Foreign Application Priority Data

Oct. 13, 1990 [DE] Fed. Rep. of Germany ..... 4032593

[51] Int. Cl.[5] ..... F01L 1/02; F01B 1/04; F02B 67/04; F02B 75/22

[52] U.S. Cl. ..... 123/90.31

[58] Field of Search ..... 123/90, 31, 192 B

[56] References Cited

U.S. PATENT DOCUMENTS

| | | | |
|---|---|---|---|
| 3,452,610 | 7/1969 | Beasley . | |
| 3,502,059 | 3/1970 | Davis . | |
| 4,131,096 | 12/1978 | Mitchell | 123/90.31 |
| 4,606,310 | 8/1986 | Makino | 123/192 B |
| 4,617,882 | 10/1986 | Matsumoto | 123/90.31 |
| 4,632,072 | 12/1986 | Brogdon | 123/192 B |
| 4,633,826 | 1/1987 | Tominaga et al. | 123/90.31 |
| 4,671,223 | 6/1987 | Asano et al. | 123/90.31 |
| 4,745,887 | 5/1988 | Ito et al. | 123/90.31 |
| 4,753,199 | 6/1988 | Melde-Tuczai et al. | 123/90.31 |
| 4,841,789 | 6/1989 | Ochiai | 123/90.31 |
| 4,957,078 | 9/1990 | Ohkawa et al. | 123/90.31 |

FOREIGN PATENT DOCUMENTS

| | | | |
|---|---|---|---|
| 11378 | 5/1980 | European Pat. Off. | 123/192 B |
| 1039307 | 9/1958 | Fed. Rep. of Germany . | |
| 1201609 | 9/1965 | Fed. Rep. of Germany . | |
| 1476021 | 3/1970 | Fed. Rep. of Germany . | |
| 2746476 | 4/1979 | Fed. Rep. of Germany . | |

OTHER PUBLICATIONS

Automobile Magazine, ATZ 73 (1971) 55, pp. 179-182 (No translation).

Automobile Magazine, ATZ 71(1969) 9, pp. 313-321 (No translation).

*Primary Examiner*—E. Rollins Cross

*Assistant Examiner*—Weilun Lo

*Attorney, Agent, or Firm*—Evenson, Wands, Edwards, Lenahan & McKeown

[57] ABSTRACT

A reciprocating engine has two cylinder banks arranged in a V-shape and a grear drive which originates from the crankshaft and leads to a drive shaft connected with the clutch as well as to camshafts and liquid pumps for cooling water and lubricating oil of the engine. The gear drive is designed such that the crankshaft, the camshafts and liquid pumps rotate in one rotating direction, and the output shaft and the clutch rotate in the other rotating direction.

16 Claims, 3 Drawing Sheets

RECIPROCATING ENGINE WITH A GEAR DRIVE

BACKGROUND AND SUMMARY OF THE INVENTION

The invention relates to a reciprocating engine with two cylinder banks arranged in a V-shape and with a gear drive originating from the crankshaft and leading to the camshafts and liquid pumps of the engine.

This type of a reciprocating engine is known from the DE-Z Special Printing ATZ, *Automobiltechnische Zeitschrift,* 71st Year, No. Sept. 12, 1969 and 73rd Year, No. May 1971. An output shaft to the clutch driven by the crankshaft—viewed in the vertical direction of the vehicle—extends below the crankshaft and in parallel to it. It is driven by the crankshaft by way of a gearbox which is arranged in a center plane between the two crankshaft ends. The output shaft, also by way of a gearbox, drives the oil pumps arranged in the crankcase of the engine. A generator, which is screwed on top to the engine power section, is used for the power supply of the engine.

It is an object of the invention to develop a gear drive to the camshafts and to the liquid pumps required for the lubrication and cooling of the engine in such a manner that the reaction torques, which occur in the case of rotational speed changes at the engine power section, are largely compensated.

This object is achieved in preferred embodiments of the invention by means of an engine arrangement wherein the crankshaft, the camshafts, and liquid pumps rotate in one rotating direction, and the output shaft and the clutch rotate in the other opposite rotating direction. If the output shaft to the clutch rotates in the opposite direction of the rotation of the crankshaft, the camshafts and the liquid pumps, the countertorques to the drive torques are reduced which affect the engine in the case of rotational speed changes. The symmetrical arrangement of the drive gears and the shafts with respect to the V-center also promotes this desired compensation of torques in preferred embodiments. This advantage is particularly noticeable in the case of racing engines with very high maximal rotational speeds of approximately 14,000 revolution per minute and fast rotational speed changes of the engine.

In a further development of preferred embodiments of the invention, the gear drive originating from the crankshaft is disposed in a center plane between the two ends of the crankshaft. It is therefore achieved that the torsional vibration deflections entering the gear drive are reduced to a minimum. The reason is that the vibration form resulting in the largest deflection has a junction in the center plane. By means of the selection of this quiet zone for a center gear drive output, the driving devices and the liquid pumps remain largely free of torsional vibration deflections of the camshaft.

Other objects, advantages and novel features of the present invention will become apparent from the following detailed description of the invention when considered in conjunction with the accompanying drawings.

DETAILED DESCRIPTION OF THE DRAWINGS

Figure 1:
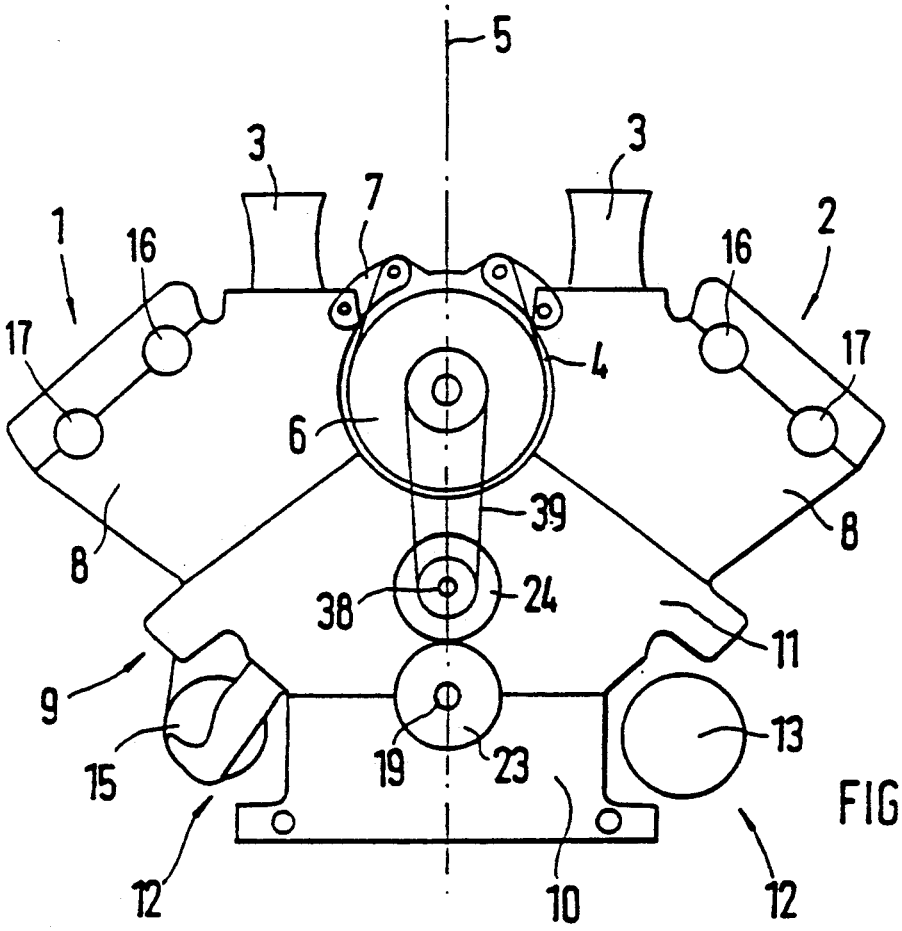
FIG. 1 is a schematic front view of a reciprocating engine constructed according to a preferred embodiment of the invention.

A 12 cylinder reciprocating engine has two cylinder banks 1 and 2 with 6 cylinders respectively and arranged in a V-shaped with respect to one another. A generator 6 is arranged in the V-cutout 4 in the V-center 5. It is screwed to the cylinder heads 8 by means of brackets 7.

Fluid pumps 12 are arranged on both longitudinal sides of the crankcase 9 which is composed of a bottom part 10 and a top part 11. Each pump unit of the liquid pumps comprises a water pump 13, an oil suction pump 14 and an oil pressure pump 15. Two parallel camshafts respectively are disposed in the cylinder heads 8 of the two cylinder banks 1 and 2.

Figure 2:
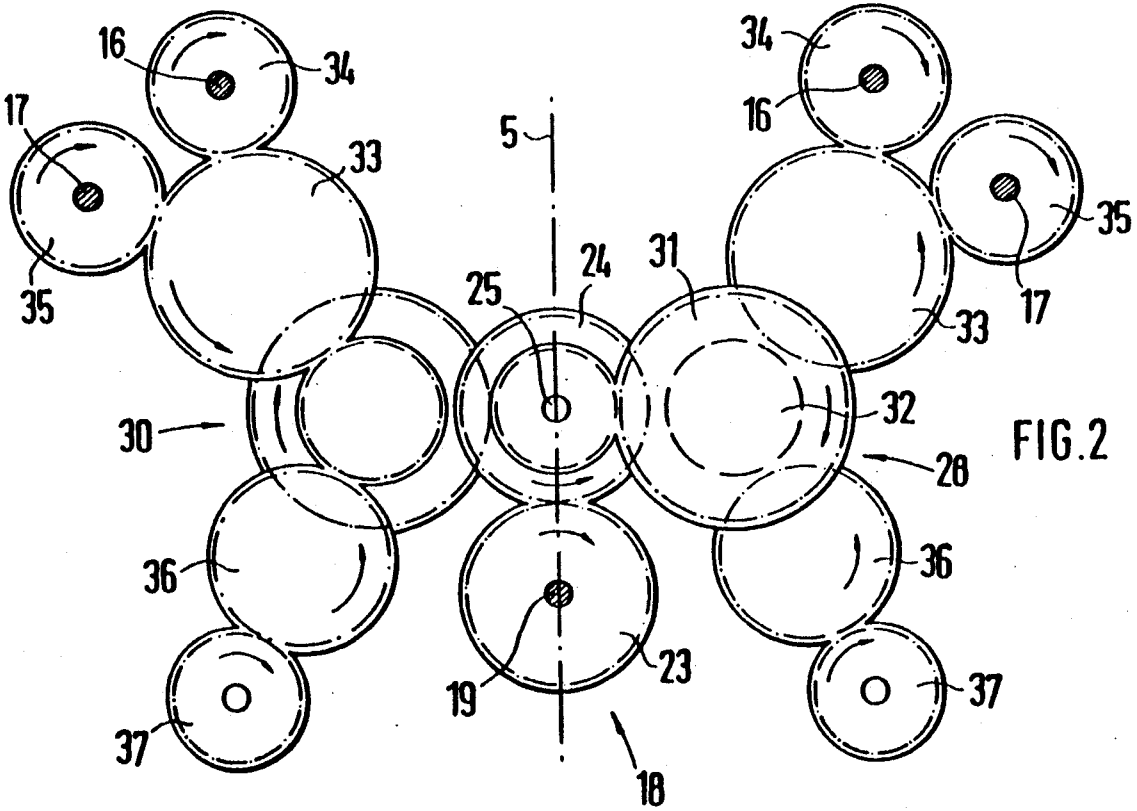
FIG. 2 is a schematic front view of a center gear drive arrangement for the engine of FIG. 1.
Figure 3:
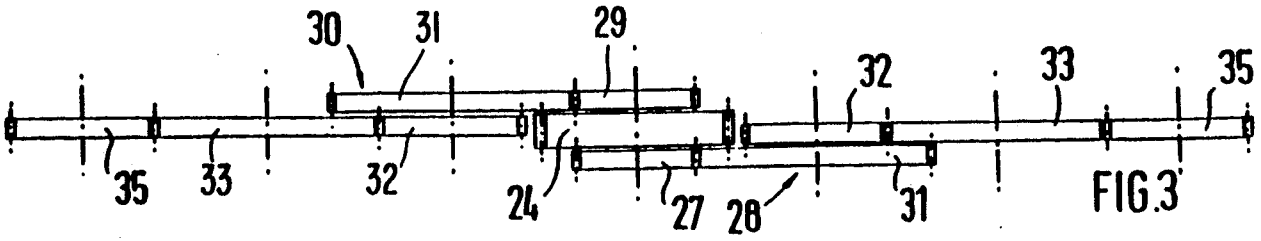
FIG. 3 is a schematic top view of the gear drive according to FIG. 2.
Figure 4:
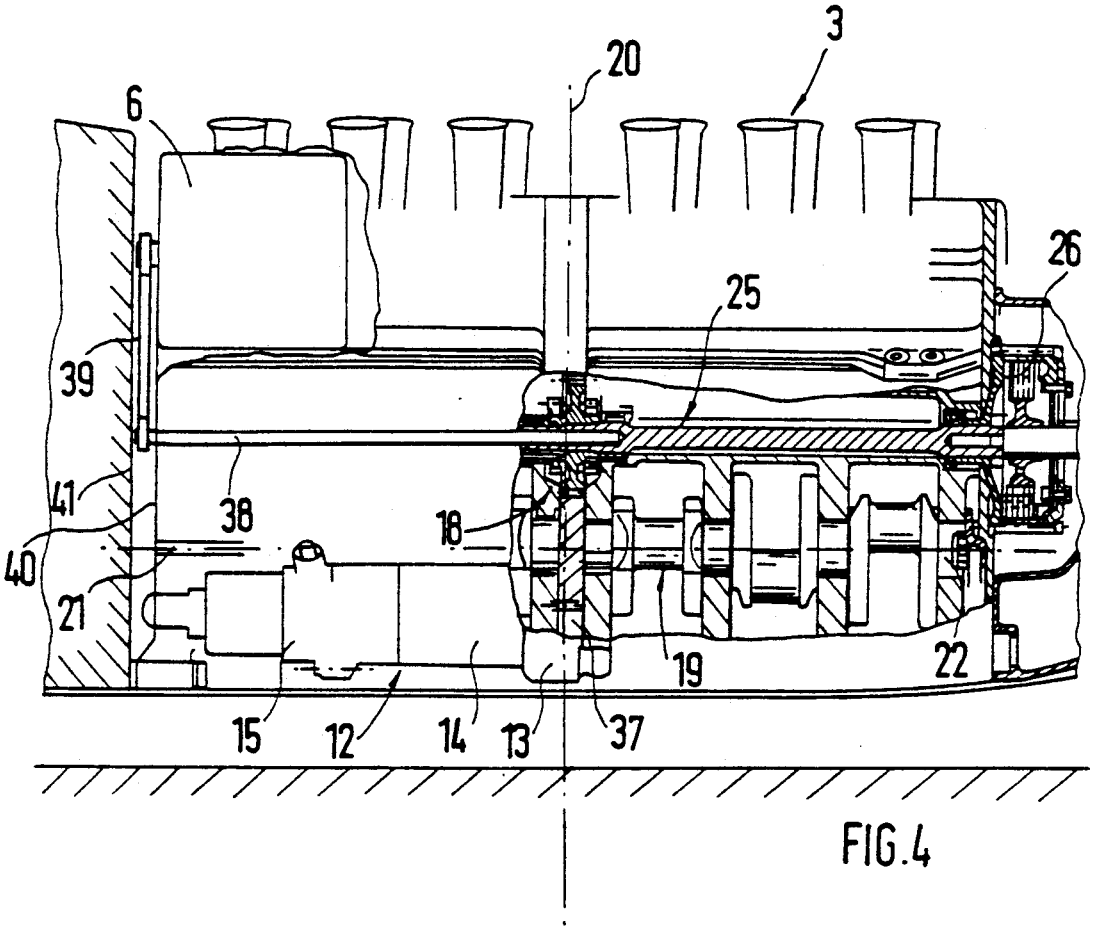
FIG. 4 is a schematic lateral view and a partial longitudinal sectional view of the reciprocating engine of FIGS. 1-3.

Referring to FIG. 2, inlet camshaft 16 actuates the inlet valves; and outlet camshaft 17 actuates the outlet valves at respective sides of the engine. A gear drive 18 consisting of spur gears which mate with one another and which is driven by a crankshaft 19 is used for driving the camshafts 16, 17 and the liquid pumps 12. The gear drive 18 is arranged in a center plane 20 of the engine which is situated approximately in the center between the forward end 21 and the rearward end 22 of the crankshaft 19 and transversely to it.

By means of a pair of gears 23, 24, the crankshaft 19 drives an output shaft 25 which is disposed above and in parallel to it and is connected with a clutch 26 arranged on the rearward side end of the engine. A gear 27 of the output shaft 25 mates with a right drive gear 28 by which the camshafts and liquid pumps are driven which are disposed on the right of the V-center 5. An additional coaxial gear 29 of the output shaft 25 engages with a left drive gear 30 for the drive of the camshafts and liquid pumps arranged on the left of the V-center 5.

Both drive gears 28, 30 comprise a larger drive gear 31 which mates with the gear 27 or 29 of the output shaft 25, and a smaller drive gear 32 by which the camshafts 16, 17 and the liquid pumps 12 are driven. For this purpose, the inlet camshaft carries a gear 34, and the outlet camshaft 17 carries a gear 35 which are jointly driven by the drive gear 32 by way of an upper intermediate timing gear 33. The same drive gear 32 mates with a lower intermediate timing gear 36 which drives a pump gear 37 by which the water pump 13, the oil pump 14, and the oil pressure pump 15 are driven jointly.

The generator 6 is driven by means of an intermediate shaft 38, which is arranged coaxially and non-rotatably with respect to the output shaft 25, and is driven by way of a belt drive 39 originating from it. The belt drive is situated between the forward side 40 of the engine and a bulkhead 41 of the vehicle body. The intermediate shaft 38 is constructed as a thin spring torsion rod in order to diminish load impacts in the transmission line.

Further details of the pump unit arrangement are included by reference to my co-pending, commonly assigned application Ser. No. 668,930, filed on even date herewith, based on German application P 40 32 591.1, filed Oct. 13, 1990.

Further details of the camshaft drive arrangements are included by reference to my co-pending, commonly assigned application Ser. No. 668,602, filed on even date herewith, based on German application P 40 32 590.3, filed Oct. 13, 1990.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A reciprocating engine with two cylinder banks arranged in a V-shape and with a gear drive which originates from a crankshaft and leads to an output shaft connected with a clutch as well as to camshafts and liquid pumps for cooling water and lubricating oil of the engine, wherein the crankshaft, the camshafts, and liquid pumps rotate in one rotating direction, and the output shaft and the clutch rotate in the other opposite rotating direction.

2. A reciprocating engine according to claim 1, wherein the gear drive is arranged on a center plane which is situated approximately in the center between the two ends of the crankshaft and transversely to it.

3. A reciprocating engine according to claim 1, wherein the output shaft extends in a V-center below a V-cutout and above the crankshaft in parallel to the crankshaft and is driven by it by means of a pair of gears of the gear drive.

4. A reciprocating engine according to claim 2, wherein the output shaft extends in a V-center below a V-cutout and above the crankshaft in parallel to the crankshaft and is driven by it by means of a pair of gears of the gear drive.

5. A reciprocating engine according to claim 3, wherein a first gear of the output shaft mates with a left gear for the drive of the camshafts and liquid pumps disposed on the left of the V-center, and wherein a second gear mates with a right drive gear for the drive of the camshafts and liquid pumps situated on the right of the V-center.

6. A reciprocating engine according to claim 4, wherein a first gear of the output shaft mates with a left gear for the drive of the camshafts and liquid pumps disposed on the left of the V-center, and wherein a second gear mates with a right drive gear for the drive of the camshafts and liquid pumps situated on the right of the V-center.

7. A reciprocating engine according to claim 5, wherein the output shaft and the first and second drive gears are situated at the same vertical level.

8. A reciprocating engine according to claim 6, wherein the output shaft and the first and second drive gears are situated at the same vertical level.

9. A reciprocating engine according to claim 5, wherein the first and second drive gears comprise a larger gear mating with the gear of the output shaft, and a smaller drive gear by means of which the camshafts and the liquid pumps are driven.

10. A reciprocating engine according to claim 6, wherein the first and second drive gears comprise a larger gear mating with the gear of the output shaft, and a smaller drive gear by means of which the camshafts and the liquid pumps are driven.

11. A reciprocating engine according to claim 9, wherein the first or second drive gears drives the gears disposed on the inlet camshaft and the outlet camshaft by way of an upper intermediate timing gear and drives a pump gear for driving the water pump, oil suction pump and oil pressure pump arranged coaxially on the outside on the crankcase by means of a lower intermediate timing gear.

12. A reciprocating engine according to claim 10, wherein the first or second drive gears drives the gears disposed on the inlet camshaft and the outlet camshaft, by way of an upper intermediate timing gear and drives a pump gear for driving the water pump, oil suction pump and oil pressure pump arranged coaxially on the outside on the crankcase by means of a lower intermediate timing gear.

13. A reciprocating engine according to claim 1, wherein an intermediate shaft is non-rotatably coaxially connected to the output shaft and wherein said intermediate shaft drives a generator arranged in the V-center by means of a belt drive on the forward side of the engine.

14. A reciprocating engine according to claim 3, wherein an intermediate shaft is non-rotatably coaxially connected to the output shaft and wherein said intermediate shaft drives a generator arranged in the V-center by means of a belt drive on the forward side of the engine.

15. A reciprocating engine according to claim 11, wherein an intermediate shaft is non-rotatably coaxially connected to the output shaft and wherein said intermediate shaft drives a generator arranged in the V-center by means of a belt drive on the forward side of the engine.

16. A reciprocating engine according to claim 1, wherein a total of twelve cylinders are provided in the two cylinder banks.

* * * * *